US010953461B2

(12) United States Patent
Porter et al.

(10) Patent No.: US 10,953,461 B2
(45) Date of Patent: Mar. 23, 2021

(54) INVESTMENT CASTING METHOD INCLUDING FORMING OF INVESTMENT CASTING CORE

(71) Applicant: United Technologies Corporation, Farmington, CT (US)

(72) Inventors: Steven D. Porter, Wethersfield, CT (US); Jon E. Sobanski, Glastonbury, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 16/360,145

(22) Filed: Mar. 21, 2019

(65) Prior Publication Data

US 2020/0298302 A1 Sep. 24, 2020

(51) Int. Cl.
*B22C 9/04* (2006.01)
*B22C 9/10* (2006.01)

(52) U.S. Cl.
CPC ..... *B22C 9/04* (2013.01); *B22C 9/103* (2013.01); *B22C 9/108* (2013.01); *F05D 2230/211* (2013.01)

(58) Field of Classification Search
CPC ..... B22C 9/04; B22C 9/103; B22C 9/108
See application file for complete search history.

(56) References Cited

U.S. PATENT DOCUMENTS

| | | | | |
|---|---|---|---|---|
| 6,913,064 | B2 | 7/2005 | Beals et al. | |
| 7,861,766 | B2 | 1/2011 | Bochiechio et al. | |
| 8,782,887 | B2 * | 7/2014 | Franchet | B23P 15/04 29/889.71 |
| 8,978,385 | B2 | 3/2015 | Cunha | |
| 10,094,563 | B2 | 10/2018 | Cunha et al. | |
| 2003/0201089 | A1 * | 10/2003 | Burd | B22C 9/04 164/132 |
| 2007/0114001 | A1 * | 5/2007 | Snyder | B22C 9/10 164/369 |
| 2010/0116452 | A1 * | 5/2010 | Luczak | B22C 9/04 164/23 |
| 2016/0153658 | A1 | 6/2016 | Xu | |

FOREIGN PATENT DOCUMENTS

| | | |
|---|---|---|
| EP | 1652603 | 5/2006 |
| EP | 1769861 | 4/2007 |

OTHER PUBLICATIONS

European Search Report for European Patent Application No. 20164977.9 completed Apr. 29, 2020.

* cited by examiner

*Primary Examiner* — Kevin P Kerns
*Assistant Examiner* — Steven S Ha
(74) *Attorney, Agent, or Firm* — Carlson, Gaskey & Olds, P.C.

(57) ABSTRACT

An investment casting method includes providing a stock investment casting core, bending the stock investment casting core to thereby form a production investment casting core that conforms to a design cooling passage shape, and casting an alloy around the production investment casting core to form a cast article.

8 Claims, 3 Drawing Sheets

INVESTMENT CASTING METHOD INCLUDING FORMING OF INVESTMENT CASTING CORE

BACKGROUND

Gas turbine engine components, such as airfoils and combustor components, can be fabricated by investment casting. For instance, in investment casting, a ceramic or refractory metal core is arranged in a mold and coated with a wax material, which provides a desired shape. The wax material is then coated with ceramic slurry that is hardened into a shell. The wax is melted out of the shell and molten metal is then poured into the remaining cavity. The metal solidifies to form the component. The core is then removed, leaving internal passages within the component. Typically, the passages are used for cooling.

SUMMARY

An investment casting method according to an example of the present disclosure includes providing a stock investment casting core, bending the stock investment casting core to thereby form a production investment casting core that conforms to a design cooling passage shape, and casting an alloy around the production investment casting core to form a cast article.

In a further embodiment of any of the foregoing embodiments, the stock investment casting core is flat.

A further embodiment of any of the foregoing embodiments includes forming cooling features in the stock investment casting core prior to the bending.

A further embodiment of any of the foregoing embodiments includes forming cooling features in the production investment casting core after the bending.

A further embodiment of any of the foregoing embodiments includes removing the production casting core from the cast article.

In a further embodiment of any of the foregoing embodiments, the stock investment casting core is formed of refractory metal.

In a further embodiment of any of the foregoing embodiments, the stock investment casting core has a thickness of 250 micrometers to 1550 micrometers.

A further embodiment of any of the foregoing embodiments includes cutting the stock investment casting core from a sheet of refractory metal.

In a further embodiment of any of the foregoing embodiments, the bending includes conforming the stock investment casting core to a mold tool.

An investment casting method according to an example of the present disclosure includes providing a flat stock investment casting core, conforming the stock investment casting core to a mold tool to thereby form a production investment casting core, and casting an alloy around the production investment casting core.

A further embodiment of any of the foregoing embodiments includes forming cooling features in the stock investment casting core prior to the conforming.

A further embodiment of any of the foregoing embodiments includes forming cooling features in the production investment casting core after the conforming.

In a further embodiment of any of the foregoing embodiments, the flat stock investment casting core is formed of refractory metal.

A further embodiment of any of the foregoing embodiments includes cutting the flat stock investment casting core from a sheet of refractory metal.

An investment casting method according to an example of the present disclosure includes cutting out a plurality of stock investment casting cores from a sheet of refractory metal, bending each of the stock investment casting cores to thereby form a plurality of production investment casting cores that conform to a design cooling passage shape, and casting an alloy around each of the production investment casting cores to form a plurality of cast articles.

A further embodiment of any of the foregoing embodiments includes forming cooling features in the stock investment casting cores prior to the bending.

A further embodiment of any of the foregoing embodiments includes forming cooling features in the production investment casting cores after the bending.

In a further embodiment of any of the foregoing embodiments, the stock investment casting cores are formed of refractory metal.

In a further embodiment of any of the foregoing embodiments, the stock investment casting cores each have a thickness of 250 micrometers to 1550 micrometers.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

The present disclosure is directed to investment casting and, more particularly, to the use of an investment casting core. The examples herein are presented with reference to a particular article, namely a combustor panel for a combustor of a gas turbine engine. It is to be appreciated, however, that the disclosure is not limited to combustor panels and may be extended to other articles that are fabricated by investment casting. In particular, the disclosure will benefit articles that utilize feature sizes that are obtainable by refractory metal cores.

Figure 1B:
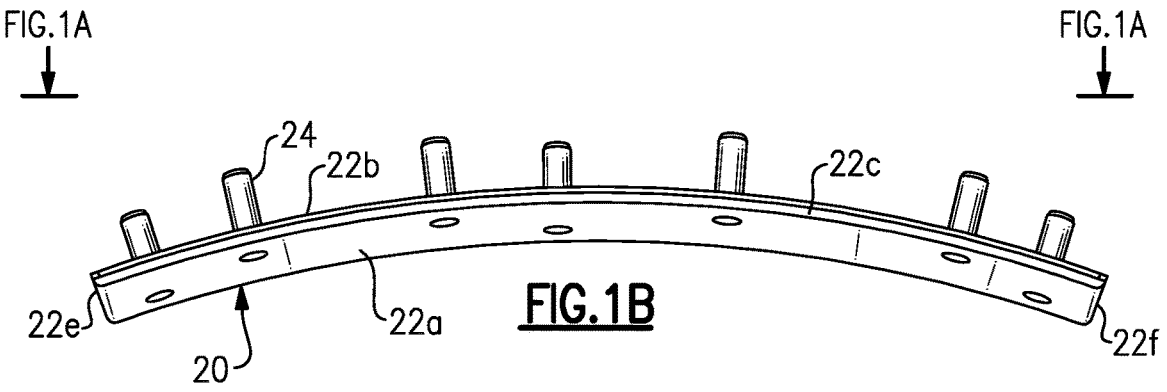
FIG. 1B illustrates an elevation view of the article of FIG. 1A.
Figure 1A:
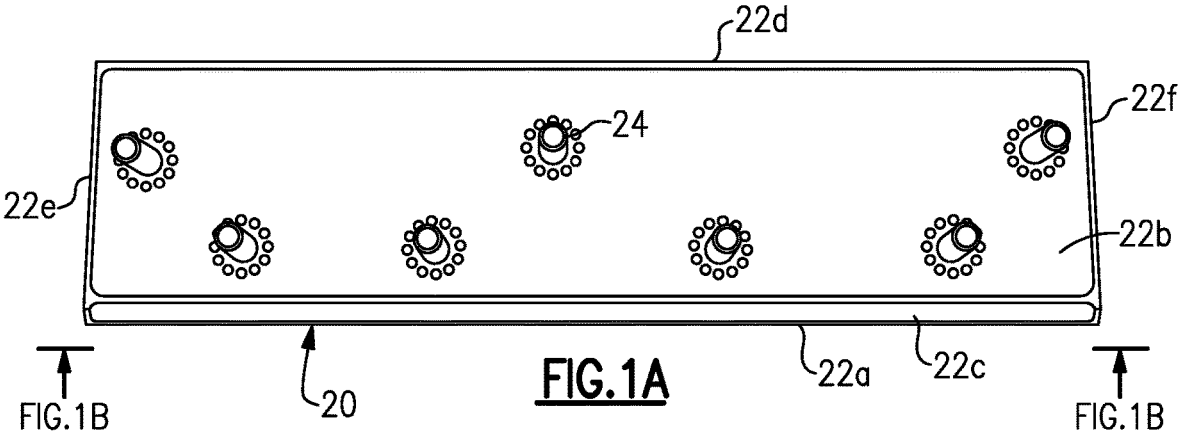
FIG. 1A illustrates a plan view of an investment cast article.
Figure 1C:
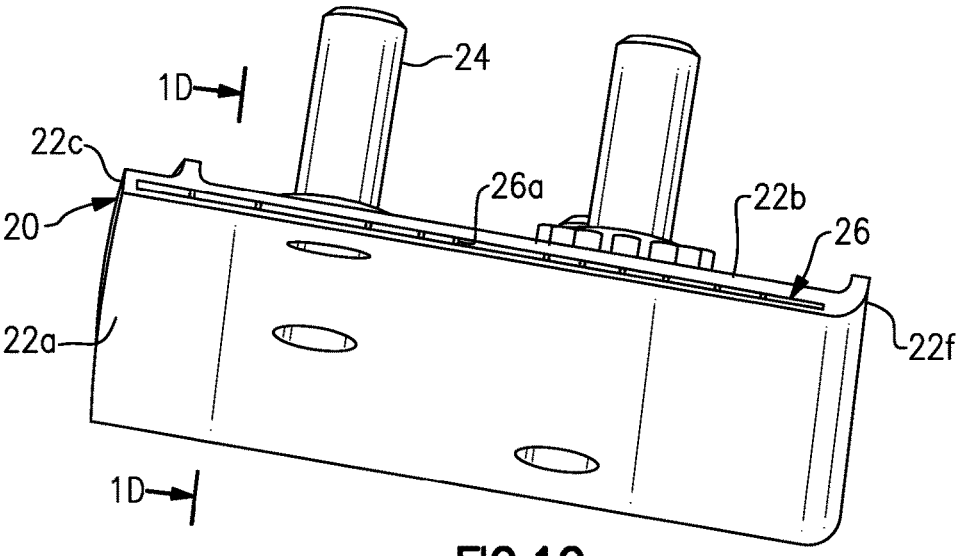
FIG. 1C illustrates a sectioned view of the article of FIG. 1A.
Figure 1D:
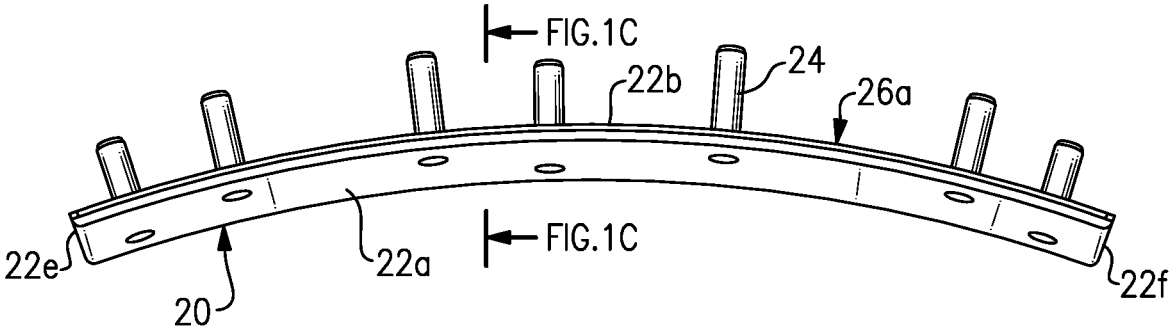
FIG. 1D illustrates another sectioned view of the article of FIG. 1A.

FIGS. 1A and 1B illustrate, respectively, a plan view and an elevation view of an example combustor panel 20. FIGS. 1C and 1D illustrate sectioned views of the combustor panel 20. The combustor panel 20 includes a panel body 22 that defines first and second sides 22*a*/22*b* and side edges 22*c*/22*d*/22*e*/22*f*. For example, the first side 22*a* borders the combustion chamber of the combustor and is thus directly exposed to combustion gases. The panel body 22 in the illustrated example is generally elongated and has an arced-shape. In a combustor, the arced-shape permits the combustor panel 20 to be placed side-by-side and/or end-to-end with other such panels around the perimeter of the combustor chamber. The combustor panel 20 includes one or more studs 24 that extend from the second side 22*b*. The studs 24 are used to mount the combustor panel 20.

As shown in the sectioned views, the combustor panel 20 further includes an internal cooling passage 26 embedded in the panel body 22. The internal cooling passage 26 may include one or more cooling features 26*a*. The cooling features 26*a* may be, but are not limited to, pedestals, flow guides, protrusions, dimples, or turbulators. As will be appreciated, the geometry, types of features, size of features, and placement of features of the combustor panel 20 may be varied according to the particular implementation.

Figure 2:
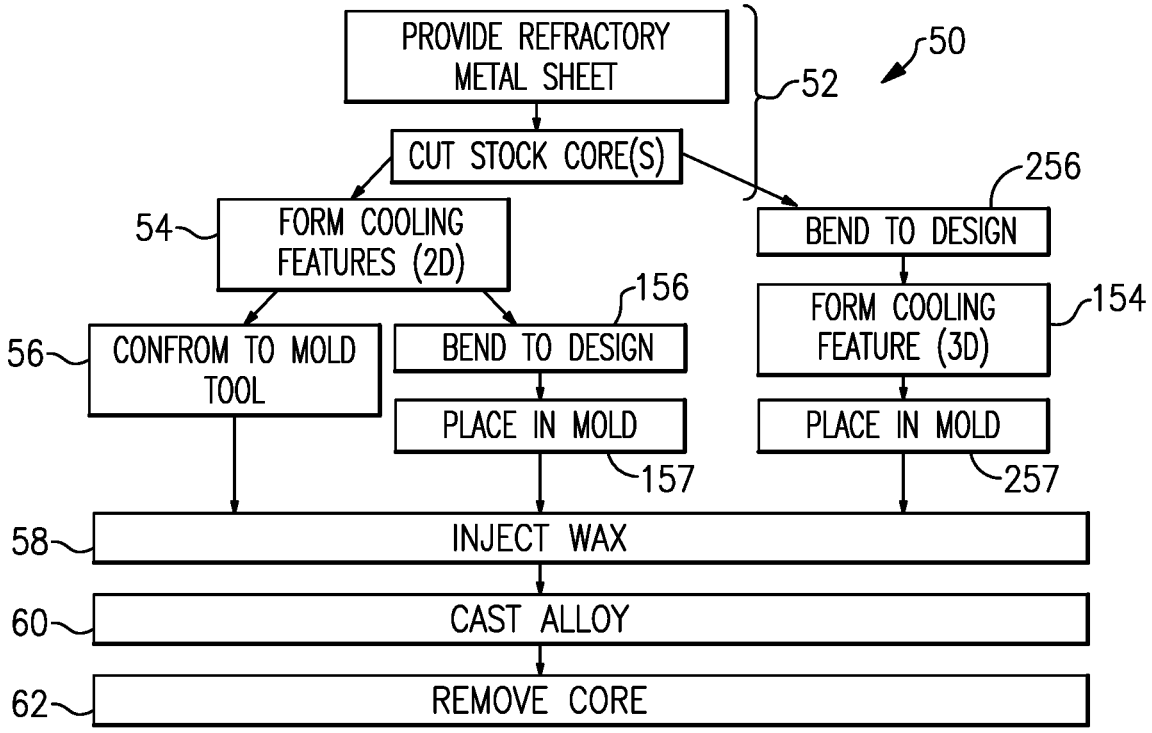
FIG. 2 illustrates an example investment casting method.

FIG. 2 illustrates an example investment casting method 50 that can be used to fabricate investment cast articles, such as the combustor panel 20. In particular, as will be described, the method 20 involves bending a stock investment casting core into the shape of the internal cooling passage 26. For instance, the shape of the internal cooling passage 26 may be determined during a design stage from testing, simulation, cooling requirements, size requirements, etc. The final shape, or design cooling passage shape, is then used to produce investment casting tooling.

The method 50 is illustrated in the form of a flow diagram. Several "branches" in the flow diagram are shown to demonstrate modifications that may be used. Additionally, it is to be understood that the method 50 is shown and described with respect to one or more example implementations. This disclosure is not limited to the example implementations, and other implementations may include additional steps or exclude one or more of the steps.

Figure 3:
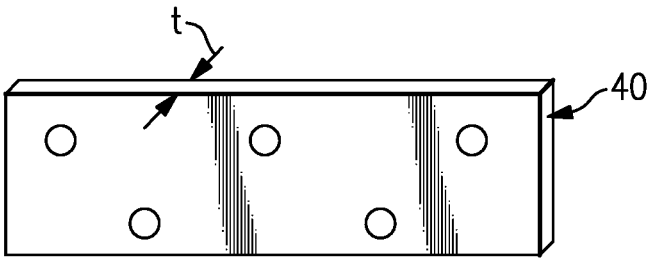
FIG. 3 illustrates a stock investment casting core for use in the method.

The method 50 begins at step 52 with the provision of a stock investment casting core. An example stock investment casting core 40 is shown in FIG. 3. The stock investment casting core 40 is formed of a refractory metal or refractory metal alloy. For this disclosure, refractory metals include niobium, molybdenum, tantalum, tungsten, rhenium, titanium, vanadium, chromium, zirconium, hafnium, ruthenium, rhodium, osmium, and iridium. Most typically, however, the stock investment casting core 40 will be formed of molybdenum or molybdenum alloy.

Figure 4:
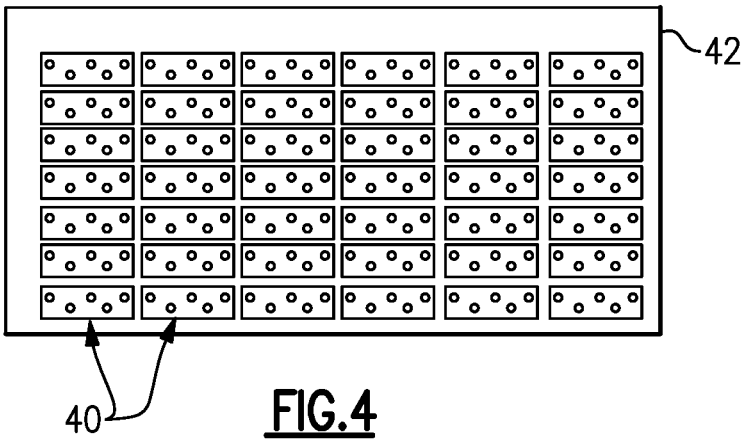
FIG. 4 illustrates cutting of the stock investment casting core from a sheet of refractory metal.

As shown in FIG. 4, the stock investment casting core 40 may be cut from a sheet 42 of refractory metal. Laser cutting may be used, but the cutting technique is not particularly limited and may alternatively or additionally include electrodischarge machining, waterjet, or stamping. Most typically, a plurality of the stock investment casting cores 40 can be cut from the sheet 42.

The sheet 42, and thus the stock investment casting core 40, is relatively thin to permit the stock investment casting core 40 to later be bent or conformed. As an example, if the stock investment casting core 40 is extremely thick it will be difficult to bend or conform to the desired shape. On the other hand, if the thickness of the stock investment casting core 40 is extremely thin, it will be difficult to properly handle the sheet 42 and the stock investment casting core 40 while preserving the shape (e.g., damage from inadvertent folding or tearing). In this regard, a useful range for the thickness, which is represented at "t" in FIG. 3, is 250 micrometers to 1550 micrometers. In a further example, the thickness is 380 micrometers to 1020 micrometers.

In the illustrated example, the sheet 42 is flat (2-dimensional), at least within known typical tolerances, and the stock investment casting core 40 is thus also flat. The flat shape facilitates cutting, as complex cutting tools or techniques for 3-dimensional cutting are avoided. As will be appreciated, the stock investment casting core 40 may alternatively be non-flat, in the form of a contoured precursor shape to the shape of the cooling passage 26. However, the benefits of the simplicity of processing the flat shape may be lost.

Referring again to FIG. 2, the stock investment casting core 40 may be pre-fabricated at some earlier time and/or place and then furnished as a starting material for the method 50. In such an instance, rather than fabrication serving as the provision of the stock investment casting core 40, the provision is the introduction of the stock investment casting core 40 into the method 50 as the starting material.

Whether fabricated as part of the method 50 or provided as a starting material, the next step 54 is to form the cooling features 26*a* in the stock investment casting core(s) 40. As discussed above, the cooling features 26*a* are not particularly limited. Such features may be formed in the stock investment casting core 40 by the forming techniques of machining, etching, grinding, etc. For instance, one or more features of one or more geometries may be formed using one or more forming techniques.

The stock investment casting core 40 is bent at step 56 to thereby form a production investment casting core that conforms to the design cooling passage shape, i.e., the shape of the cooling passage 26. The word "production" connotes that the core has been accorded the shape of the cooling passage 26. This does not, however, preclude subtractive or additive manufacturing techniques that may be used after the bending to provide additional features on the core.

In one example of the bending in which the stock investment casting core 40 is initially flat, the stock investment casting core 40 is bent to the arced shape of the cooling passage 26. In this regard, the combustor panel 20 is especially amenable to the method 50 because it requires only a single-order bending of the flat shape about a single axis into the arced shape. More complex, second-order, shapes that require bending about two axes, such as arced shapes with a twist offset, may also be employed in the method 50. Further complex shapes, such as those requiring bending about three or more axes, especially with high radii of curvature, may introduce wrinkles or other defects.

The bending can be conducted using one or more of several bending techniques. For example, in step 54, the stock investment casting core 40 is bent by conforming the stock investment casting core 40 to a mold tool that has the arced shape of the cooling passage 26. That is, the act of conforming involves bending the core 40 to follow the contour or contours of the mold tool. In contrast, as will be described in more detail below, the core may alternatively be bent freestyle, without the aid of a mold tool to conform to.

The mold tool is part of mold equipment used to inject and form the wax body for the investment casting. Most typically, such equipment includes a mold tool that has a mold cavity therein. The mold tool may be divided into two halves that may be opened and closed in conjunction with the wax molding process.

For example, the stock investment casting core 40 may be positioned in one of the mold halves during the bending process. Stand-offs or other positioning features may be included in the mold cavity and/or on the stock investment casting core 40 to properly locate the core 40 in the mold cavity. An operator or automated machine may bend the stock investment casting core 40 into conformance with the mold tool during the positioning. For instance, the operator or automated machine applies a force on the stock investment casting core 40 to bend it toward the mold tool so that, after the bending, the production investment casting core follows the contour or contours of the mold tool and thus conforms to the design cooling passage shape.

Additionally or alternatively, the closing of the mold tool halves may bend the stock investment casting core 40. For instance, the stock investment casting core 40 may initially be flat when placed into one of the halves, and the force of closing the mold halves may exert a bending force on the stock investment casting core 40 as the mold closes to conform the stock investment casting core 40 to the shape.

After the bending at step 54, the wax is then injected at step 58 into the mold cavity. To be clear, the mold cavity and the tool in which the mold cavity resides is the same tool that may be used above to bend the core 40. Thus, an additional tool dedicated to forming the core may be avoided. The wax flows around the stock investment casting core 40 and takes the shape of the mold cavity upon solidification, i.e., the shape of the panel body 22.

The stock investment casting core 40 is permanently deflected during the bending in step 56 to produce the production investment casting core. However, due to the elastic or non-plastic component of the deflection during bending, there may be some "spring-back" of the production investment casting core once the bending force is released. To the extent that there would be significant "spring-back," the solidified wax resists such "spring-back" and holds the production investment casting core in the desired shape.

At step 60, the molten alloy is cast. Step 60 may involve coating the wax with ceramic slurry that is then hardened into a shell. The wax is then melted out of the shell and the molten metal is poured into the remaining cavity and then cooled to form the panel body 22 (or other article).

Finally, at step 62, the production investment casting core is removed from the panel body 22. As an example, the production investment core is removed. A caustic solution may be used to leach the core for removal, but other removal techniques may alternatively or additionally be used. Steps 58, 60, and 62 are conventional investment casting steps and, given this disclosure, one of ordinary skill in the art will understand how to employ these step within the method 50.

The bending employed at step 56 is a conforming type of bending in which the stock investment casting core 40 is bent against the mold tool to follow the contour or contours of the mold tool. Alternatively, at step 156, the stock investment casting core 40 is bent freestyle, without the aid of the mold tool to conform to.

In one example, the stock investment casting core 40 is bent in a partial-freestyle technique in which a separate template guide is used as a sort of surrogate for the mold tool. For instance, the template has the arced shape of the cooling passage 26 and the stock investment casting core 40 is bent against the template, by an operator or automated machine, to thereby form the production investment casting with the design cooling passage shape.

In another example, the stock investment casting core 40 is bent in a fully-freestyle technique in which no separate template guide is used. For instance, the stock investment casting core 40 is bent freehand, by an operator or automated machine, without the aid of guide template against which the core 40 is pressed. Although not limited, this may be accomplished by grasping the ends of the stock investment casting core 40 and then pivoting the grasped ends to impart a bending force. The magnitude of the pivoting and bending may be controlled such that the production investment casting core has the desired design cooling passage shape.

After step 156, at step 157, the production investment casting core is then placed into the mold tool, followed by the steps 58, 60, and 62 as described above.

In the prior examples, the forming of the cooling features **26*a* at step 56 are performed before the bending steps 56/156. Alternatively, at step 256, the stock investment casting core 40 is bent before the forming of the cooling features 26*a*. For example, at step 256 the stock investment casting core 40 is bent freestyle as described above to form the production investment casting core. This is then followed by step 154 of forming the cooling features 26*a* in the production investment casting core. As discussed above, the cooling features 26*a*** are not particularly limited and may be formed by the forming techniques of machining, etching, grinding, etc.

After step 154, at step 257, the production investment casting core is then placed into the mold tool, followed by the steps 58, 60, and 62 as described above.

The method 50 may facilitate providing a simple, efficient, and lower cost use of a refractory metal cores, particularly for low-complexity geometry components such as combustor panels. For instance, the use of a refractory metal core avoids use of known ceramic cores, which are fragile, as well as additional expensive hard tooling required to produce ceramic cores. Additionally, the bending of the stock core or cores to produce the shape of the cooling passage may facilitate avoiding complex and expensive forming processes, such as forging Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. An investment casting method comprising:

providing a stock investment casting core;

bending the stock investment casting core in a mold tool that has mold tool halves to thereby form a production investment casting core that conforms to a design cooling passage shape, wherein the bending includes positioning the stock investment casting core in one of the mold tool halves that is contoured in accordance with the design cooling passage shape and applying a force on the stock investment casting core to bend the stock investment casting core toward the one of the mold tool halves so that the stock investment casting core conforms to the design cooling passage shape, wherein the applying of the force is by closing the mold tool halves;

injecting a wax into the mold tool around the production investment casting core; and casting an alloy around the production investment casting core to form a cast article.

2. The method as recited in claim 1, wherein the stock investment casting core is flat.

3. The method as recited in claim 1, further comprising forming cooling features in the stock investment casting core prior to the bending.

4. The method as recited in claim 1, further comprising removing the production casting core from the cast article.

5. The method as recited in claim 1, wherein the stock investment casting core is formed of refractory metal.

6. The method as recited in claim 5, wherein the stock investment casting core has a thickness of 250 micrometers to 1550 micrometers.

7. The method as recited in claim 1, further comprising cutting the stock investment casting core from a sheet of refractory metal.

8. The method as recited in claim 1, wherein the stock investment casting core includes features for forming at least one of pedestals, protrusions, or turbulators.

* * * * *